US006325009B1

(12) United States Patent
Schulz et al.

(10) Patent No.: US 6,325,009 B1
(45) Date of Patent: Dec. 4, 2001

(54) SAILBOAT FOR SAILING IN SHALLOW WATER

(75) Inventors: Walter A. Schulz, Portsmouth, RI (US); George J. Carter, Gloucester, MA (US)

(73) Assignee: Shoalsailer, LLC, Bristol, RI (US)

( * ) Notice: Subject to any disclaimer, the term of this patent is extended or adjusted under 35 U.S.C. 154(b) by 0 days.

(21) Appl. No.: 09/583,262

(22) Filed: May 31, 2000

(51) Int. Cl.[7] ..... B63B 1/04; B63B 3/38

(52) U.S. Cl. ..... 114/56.1; 114/138; 114/140; 114/141

(58) Field of Search ..... 114/39.25, 39.21, 114/56.1, 61.27, 61.29, 61.3, 61.31, 140, 138, 142, 163, 129, 141

(56) References Cited

U.S. PATENT DOCUMENTS

| | | | |
|---|---|---|---|
| 518,702 | | 4/1894 | Schermerhorn . |
| 890,045 | | 6/1908 | Granrose . |
| 3,085,535 | | 4/1963 | Hunt . |
| 3,259,093 | * | 7/1966 | Taylor . |
| 3,871,322 | | 3/1975 | Dodge . |
| 4,044,703 | | 8/1977 | Kurtz . |
| 4,377,124 | | 3/1983 | Guigan . |
| 4,378,748 | | 4/1983 | Kurtz . |
| 4,449,468 | | 5/1984 | Schulz et al. . |
| 4,463,699 | | 8/1984 | Lineback . |
| 4,561,371 | | 12/1985 | Kelley et al. . |
| 4,856,445 | | 8/1989 | Kiper . |
| 4,993,342 | | 2/1991 | Eymard . |
| 5,009,178 | | 4/1991 | Geffken . |
| 5,636,585 | | 6/1997 | Schulz . |

FOREIGN PATENT DOCUMENTS

| | | | | |
|---|---|---|---|---|
| 298 050-A1 | * | 1/1989 | (EP) . | |
| 2 416 158 | * | 8/1979 | (FR) | 114/140 |

* cited by examiner

*Primary Examiner*—Sherman Basinger
(74) *Attorney, Agent, or Firm*—Salter & Michaelson

(57) ABSTRACT

A sailboat having a novel hull shape, a fixed, shallow keel, dual rudders, and retractable, shallow dagger boards for sailing in shallow or shoal water is provided. The combination of features allows the boat to achieve performance sailing at all points of wind, and in both deep and shallow water. The hull preferably has a hydrodynamic shape which provides lift and lateral resistance to the hull when sailing. The keel is preferably shallow so that the boat may be sailed in shallow water and even beached. The draft of the keel is preferably related to the length of the hull measured along the waterline. In a preferred embodiment, there is 1 inch of draft for every 1 foot of waterline. The boat may also preferably include a set of retractable dagger boards located on opposite sides of the keel. A dagger board may be extended on the leeward side of the boat when the wind exceeds about 15 knots, in order to help prevent side slippage or leeway. In a preferred embodiment, the draft of the dagger board does not exceed that of the shallow keel so as to not increase the overall draft. Dual rudders may also be provided to help prevent leeway. The dual rudders are preferably sized so as to not increase the overall draft of the sailboat.

24 Claims, 9 Drawing Sheets

SAILBOAT FOR SAILING IN SHALLOW WATER

TECHNICAL FIELD

The invention relates generally to an improved sailboat design for sailing in shallow water and, more specifically to a larger-style sailboat which can sail windward in about three feet of water or less.

BACKGROUND OF RELATED ART

The ability to control side slipping or leeway is a major factor in allowing a boat to sail windward, i.e. into the general direction of the wind, a necessary feature in any sailboat. In order to prevent a sailboat from slipping side ways as the result of wind pressure on the sail being transferred to the hull, appendages are provided which extend below the hull. Thus, fixed keels, as well as centerboards, lee boards and dagger boards have been used to prevent such side slipping and to allow sailboats to sail generally into the wind. Centerboards, lee boards and dagger boards are used in place of fixed keels in order to allow a sailboat to both sail and be beached in shallow water. Such boards are generally thin and may be retracted (i.e. raised) and extended (i.e. lowered), as required, so as to reduce and increase the draft or distance of the board below the water line, respectively. Generally, the board is raised when the wind is about aft (i.e., rear) of the mid-ship point, and generally is completely raised when sailing before the wind and when pulling the boat ashore.

Although acceptable for beaching sailboats, retractable boards do not allow a sailboat to sail well in shallow water because the boards must be raised to reduce draft and performance of the boat in sailing toward the wind suffers. For example, a 30 foot catamaran sailboat with a centerboard has a draft of only about 18 inches with the centerboard fully retracted, but has a draft of about 4 feet with the board fully lowered. In order to effectively sail to windward, the centerboard of the catamaran must be fully lowered. With the board fully raised to the 18 inch draft in shallow water, the boat will slip side ways and be largely uncontrollable when sailing windward. Thus, although such boats can be powered by a motor or the like in shallow water and thereafter beached, they cannot sail effectively in shallow water.

In order to achieve performance type sailing, especially to windward, relatively deep fixed keels or deep movable appendages need to be utilized. However, such deep keels and appendages do not allow the boat to sail in shallow or shoal water. When the water becomes too shallow, a sailboat with a fixed keel will go aground and fall over on it's side if there is not enough water to support the hull. Reduced depth, fixed keel boats have been tried in the art, however, such boats cannot be beached or grounded without problem. In addition, sailing performance characteristics of reduced depth, fixed keels are adversely affected because the shape of the keel must be compromised to reduce draft. To improve the sailing performance of such reduced depth keels, small horizontal wings have been added to the bottoms of the keels. Even with the reduced depth keels having wings, the draft is still fixed at about 4.5 feet of draft. Another approach has been to include an appendage 111 which is extendable from the bottom 113 of a keel 118 as shown in FIG. 15. However, to sail in shallow water the appendage must be retracted and, again, sailing performance (especially to windward) is adversely affected. To date, there are no performance sailboats, monohulls or multihull boats over 25 feet in length which provide true windward sailing in about 3 feet of water or less. Since over 75% of the inshore, cruising waters on the Atlantic and Gulf Coasts are 3 feet or less in depth, such waters are only accessible by sailboats over 25 feet which are under power and with appendages raised.

Another problem encountered with such reduced depth, fixed keel boats is the provision of headroom beneath the deck in the cabin. In order to create a shallow hull and keel, the area between the waterline of the boat and the deck line (also known as the freeboard) must be raised, as must the trunk cabin height in order to obtain standing headroom (i.e., 6'4") in the cabin interior. It has been found that raising the freeboard and the deck height negatively affects the center of gravity of the boat which, in turn, adversely affects sailing performance.

Accordingly, there is needed in the art a sailboat capable of sailing to windward in water which is relatively shallow (i.e. about 3 feet or less), which does not compromise sailing performance, and which can be readily beached.

SUMMARY

One object of the present invention is to provide a sailboat capable of sailing to windward in water which is relatively shallow, without adversely compromising sailing performance.

In accordance with one aspect, there is provided a sailboat having a novel hull shape along with a fixed, shallow keel, dual rudders, and retractable, shallow dagger boards. The combination of these features allows the boat to achieve performance sailing at all points of wind, and in both deep and shallow water. The hull preferably has a hydrodynamic shape which provides lift and lateral resistance to the hull when sailing. In addition, the shape of the hull is turned inward and upward, so as to form a modified "U" shape. By turning the hull inward and upward, a pronounced hollow or convex configuration in the bottom portion of the hull is formed below the waterline. The wetted surface area of the hull (i.e. surface area of the boat immersed in water) remains substantially the same for the present embodiment as for a conventional sailboat of the same size. The shape of the hull also preferably flattens out toward the aft, or rear of the boat. The preferred hull shape creates lateral and directional stability on all points of sail while also allowing for sufficient room (including headroom) below the deck in the cabin of the boat.

In addition to the shape of the hull, the boat may preferably be provided with a long, shallow keel which allows the boat to sail in shallow water. The draft of the keel is preferably related to the length of the hull measured along the waterline and is preferably about ⅓ the total draft of the boat. In a preferred embodiment, there is 1 inch of total draft (hull+keel+lowered appendages) for every 1 foot of waterline. For example, a 30 foot length boat (measured along the waterline stern to bow) would preferably have a 30 inch total draft, with the draft of the keel being about 10 inches. In one embodiment, the keel may also preferably taper from the bottom of the boat inward, and include a flat bottom to facilitate beaching.

The boat may also preferably include a set of retractable dagger boards supported by the hull and located on opposite sides of the keel. A dagger board may be extended on the leeward side of the boat when the wind exceeds about 15 knots, in order to reduce side slippage or leeway. In a preferred embodiment, the draft of the dagger boards does not exceed that of the shallow keel so as to not increase the overall draft. Dual rudders may also be provided on the stern to help prevent leeway. Again, the rudders should preferably be sized so as to not increase the overall draft of the sailboat.

The shape of the hull, dual rudders, and use of dagger boards allows for performance sailing, while minimizing the draft of the boat by utilizing a long, shallow keel (and shallow dagger boards, as needed) allows the boat to be sailed in shallow water and beached.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENTS

Figure 1:
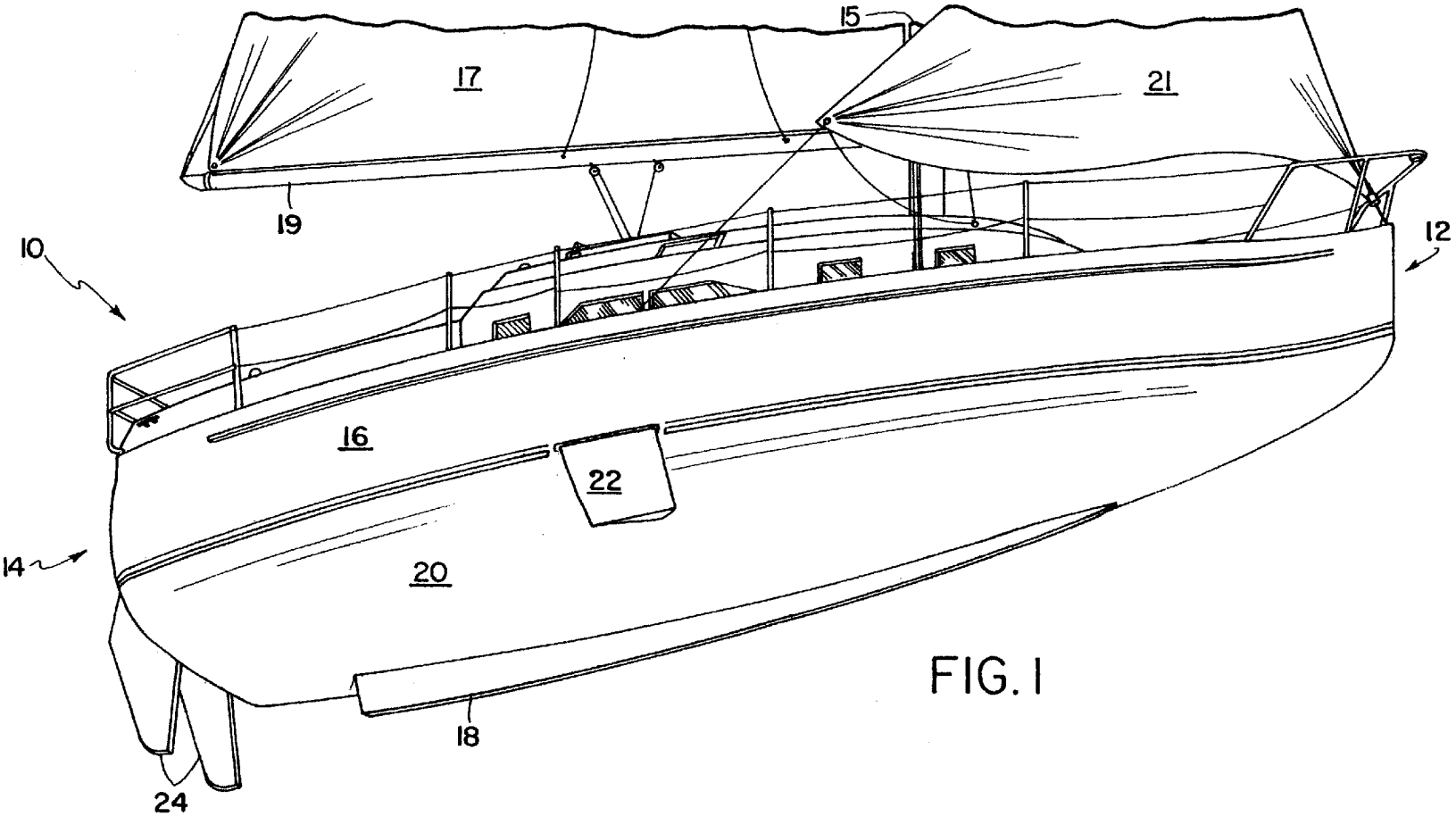
FIG. 1 is a perspective view of the hull of a sailboat according to one embodiment of the present invention.
Figure 2:
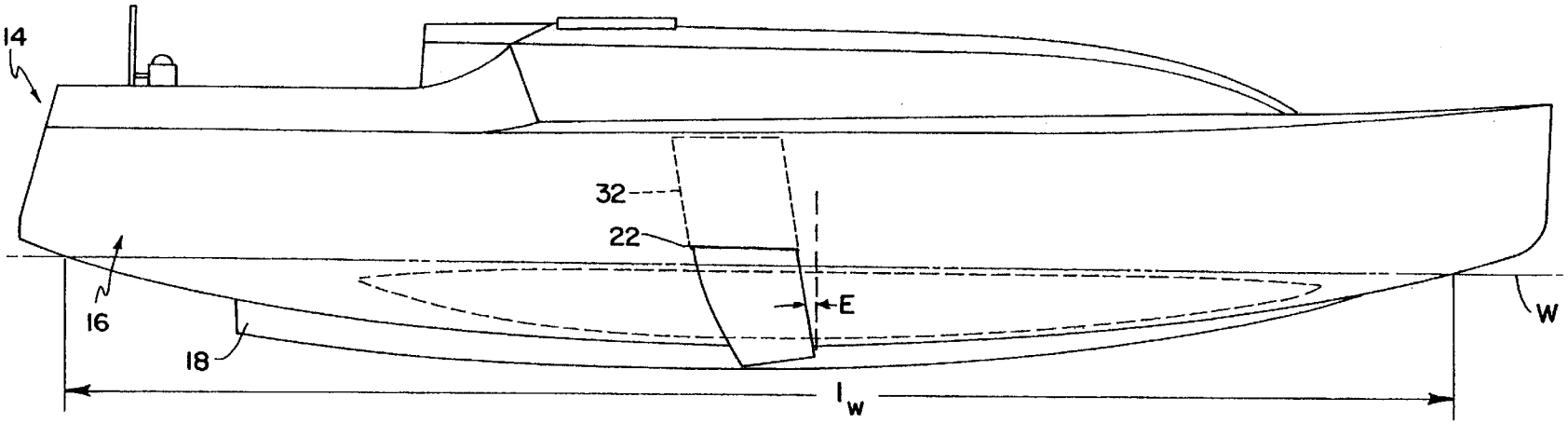
FIG. 2 is a side view of the hull of the embodiment of FIG. 1.

A sailboat 10 which is capable of sailing in shallow water, is illustrated in FIGS. 1–14. As used herein, the term "shallow" or "shoal" water refers to water generally 3 feet or less in depth for boats 35 feet or less in length. However, for boats over 35 feet, shallow water refers to 1 inch of water for each foot in length of the boat measured along the waterline. Also, as used herein, "performance" sailing refers to sailing at all points of wind without significant adverse effects such as increased drag or side slippage. The term "overall draft" or "sailing draft" refers to the depth of the boat from the waterline down to the deepest part of the boat, including appendages (such as dagger boards and rudders) in their fully lowered or extended position. The terms "windward", "leeward", "fore", "aft", "bow", "stern", "heel", "stations", etc., are all used in their conventional sense as sailing terms well-known to those of skill in the art. When the boat is static, the waterline "W" is located as shown in FIGS. 2, 4, 5, 8, 10 and 13. In the illustrative embodiment, a sailboat having an overall length of 32', and a length, "$l_w$", of 30' as measured along the waterline is described. When referring to the length of the boat herein below, the length of the boat at the waterline is the length referred to unless otherwise stated. It should be understood that the description is not limited to boats of a particular length, and may have application in boats of any size.

A sailboat 10 having a bow 12, a stern 14, and a hull 16 extending from the bow to the stern, and which is capable of sailing in shallow water is illustrated in FIGS. 1–14. The sailboat further includes a shallow keel 18 extending from an under side 20 of the hull, a pair of retractable dagger boards 22 disposed on opposite sides of the keel and also extending from the hull, and dual rudders 24 which are disposed on the stern of the boat. The boat also preferably includes a mast 15 extending from a deck of the boat and supporting a mainsail 17 and a boom 19, as is conventional. A secondary sail 21, such as a jib, which is supported at the bow of the boat may also be provided. Other components of a conventional sailboat may also be included in the present sailboat, as would be known to those of skill in the art.

Figure 4:
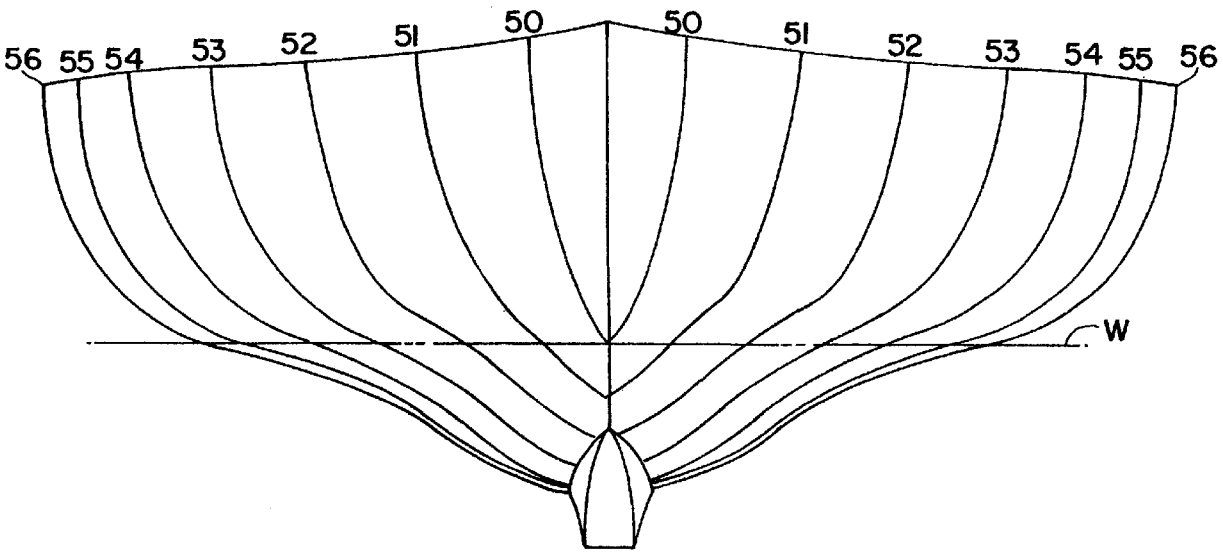
FIG. 4 is a schematic view of the hull showing the sectional lines of the hull from a front view thereof.
Figure 5:
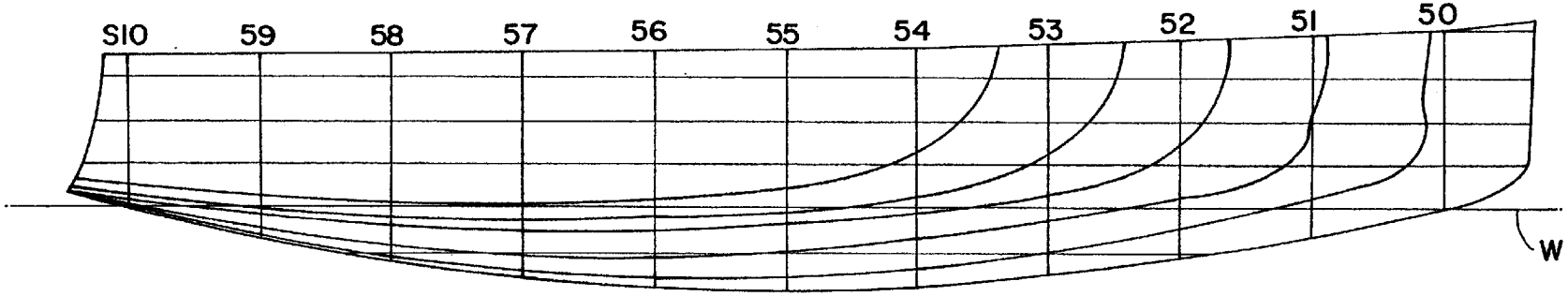
FIG. 5 is a schematic view of the hull showing the sectional lines of the hull from a side view thereof.
Figure 6:
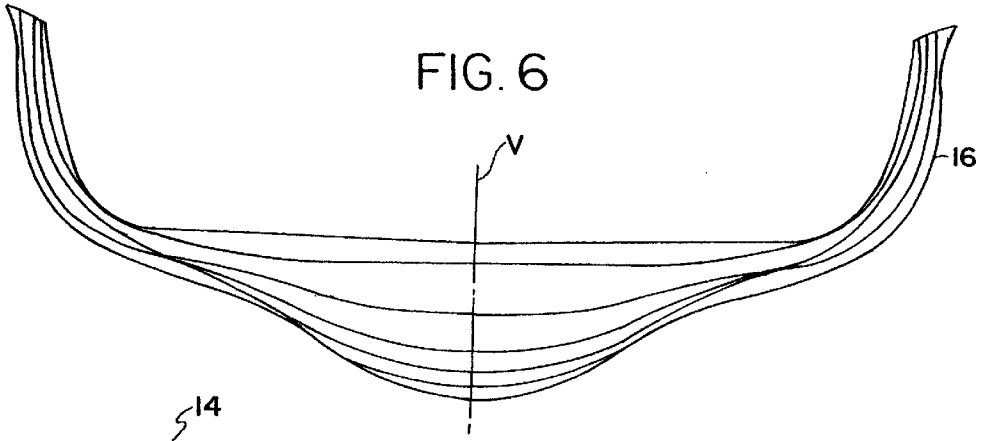
FIG. 6 is a schematic view of the hull showing the sectional lines of the hull from a cross-sectional front view thereof.

The hull of the present embodiment preferably has a hydrodynamic shape which provides lift and lateral resistance to the hull when sailing. As shown in FIGS. 4 and 5, the sections of the hull are divided into "stations", as is conventional. The hull of the present invention preferably includes 11 stations, labeled S0, S2, S3, S4, S5, S6, S7, S8, S9, and S10. The stations are preferably divided into equal parts, and are labeled according to their position along the waterline of the boat. Thus, S0 is located at the bow of the boat, S2 is located at about 20% of the waterline length (measured from the bow), and S8 is located at about 80% of the waterline length. The angle of entry ($\Sigma$) of the boat at the bow 12 is about 15 degrees (measured parallel with the waterline—FIG. 7), and the deadrise, angle "$\lambda$", of the hull is about 50 degrees, as measured at S0 (relative to horizontal, or the horizon—FIG. 8). Amidship, at S4, the deadrise is about 20 degrees, and at S8 the deadrise is about 5 degrees. Therefore, as shown in FIG. 5, the entry of the bow is very sharp, but as the sections of the hull run aft they flatten out until the transom is reached.

Figure 7:
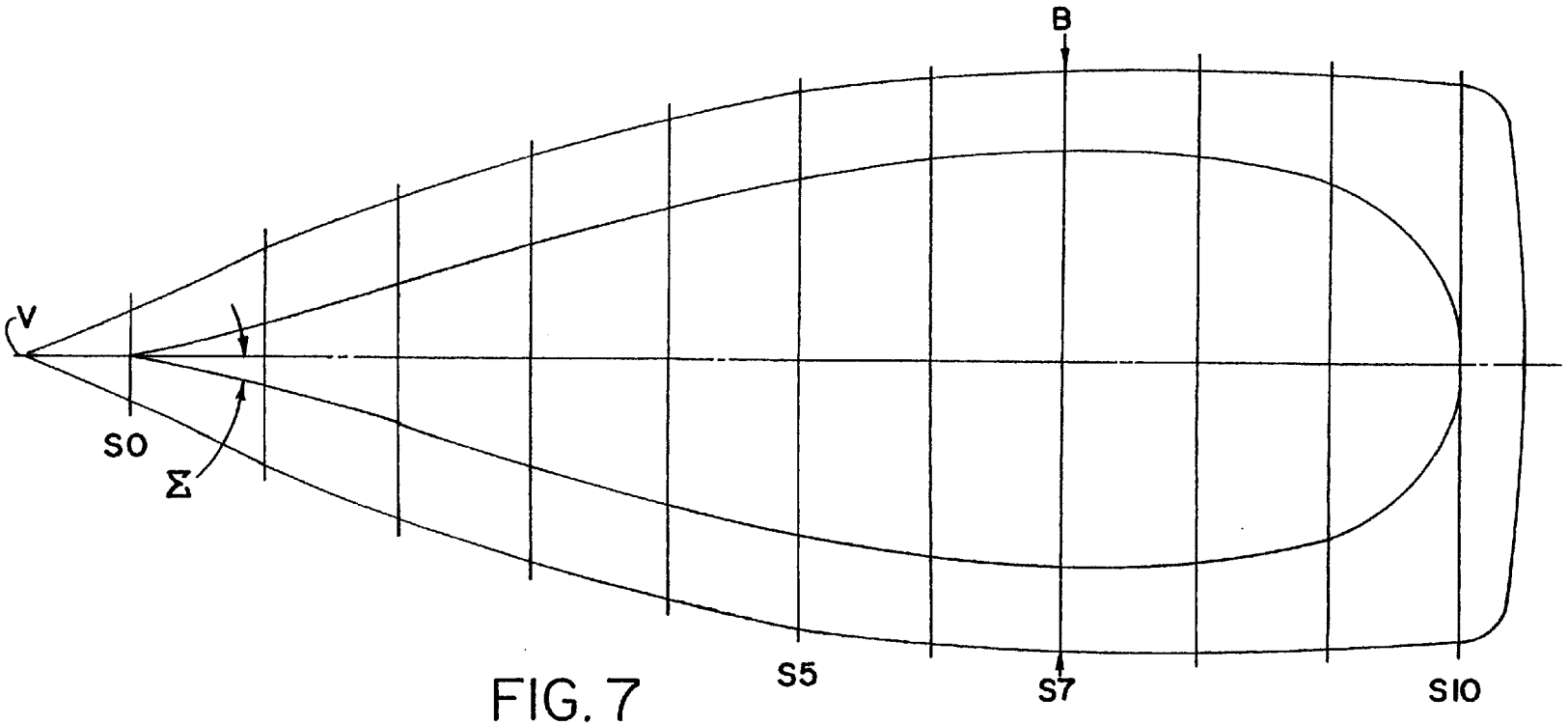
FIG. 7 is a schematic bottom view of the hull showing the angle of entry of the bow.
Figure 8:
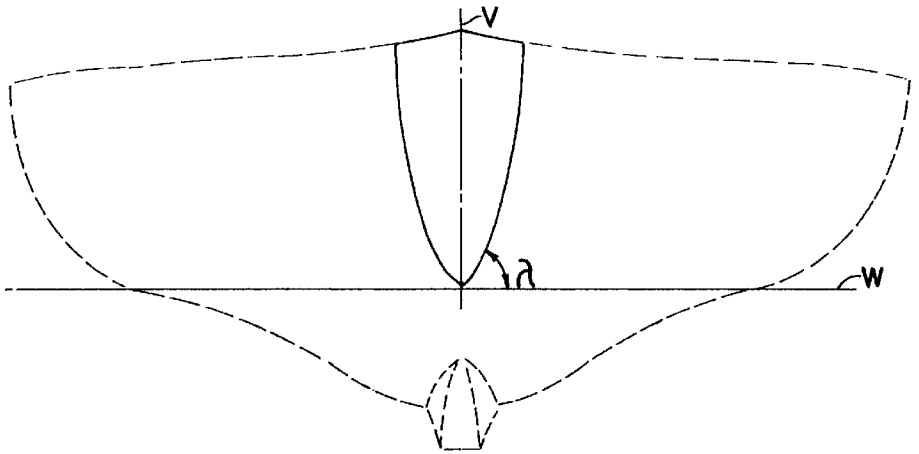
FIG. 8 is a front view of station 0 showing the deadrise angle of the bow.

The hull of the boat is also preferably wide for its length as compared to a conventional sailboat (i.e., the hull has substantial beam in relation to its length). The maximum width or beam, "B", of the hull at the waterline is preferably about 33% of the length of the boat (at the waterline) for the sailboat 10. For example, on a 30 foot waterline boat as illustrated, the maximum width at the waterline would preferably be no more than 10 feet. The maximum beam is preferably located at about 70% aft of the bow of the boat, i.e. at S7 (FIG. 7). As will be appreciated, the dimensions of the hull may differ depending upon the size of the particular boat.

In addition to the above, the shape of the hull is preferably turned inward and upward, so as to form a modified "U" shape. Conventional sailboats have a generally "U" shaped hull, as shown in dotted lines 26 in FIG. 13. In the present embodiment, the shape of the hull is modified such that the hull section is turned inward and upward (inward relative to a vertical plane "V" extending through a center of the hull along the length, and upward toward the deck) to form a pronounced hollow 28 or convex configuration in the bottom portion of the hull, which lies primarily below the waterline. The wetted surface area of the hull (i.e. surface area of the boat immersed in water) remains substantially the same for the present invention as for a conventional sailboat of the same size. By turning the hull upward and inward, while maintaining conventional wetted surface area, the hull has increased lateral and directional stability on all points of sail.

In particular, the design of the hull including the hollow area increases the lateral stability of the sailboat by substantially preventing side slippage or leeway during sailing. In conventional sailboats the keel is relied on to prevent such leeway. However, in the present embodiment, the hull design contributes substantially to the lateral stability of the boat. The increased lateral stability also allows for a smaller keel to hull ratio to be utilized when determining the draft. For example, in a conventional sailboat the draft of the boat is usually about ⅔ keel depth and ⅓ hull depth (measured from the waterline). However, in the present embodiment, the ratio is about ⅓ keel depth and ⅔ hull depth (measured from the waterline). In addition, the hull design with increased stability allows for a lesser amount of ballast to be utilized in the boat. For the present embodiment, the ballast accounts for less than about 25% of the overall weight of the boat. In conventional boats the ballast is usually about 40% of the overall weight.

Figure 13:
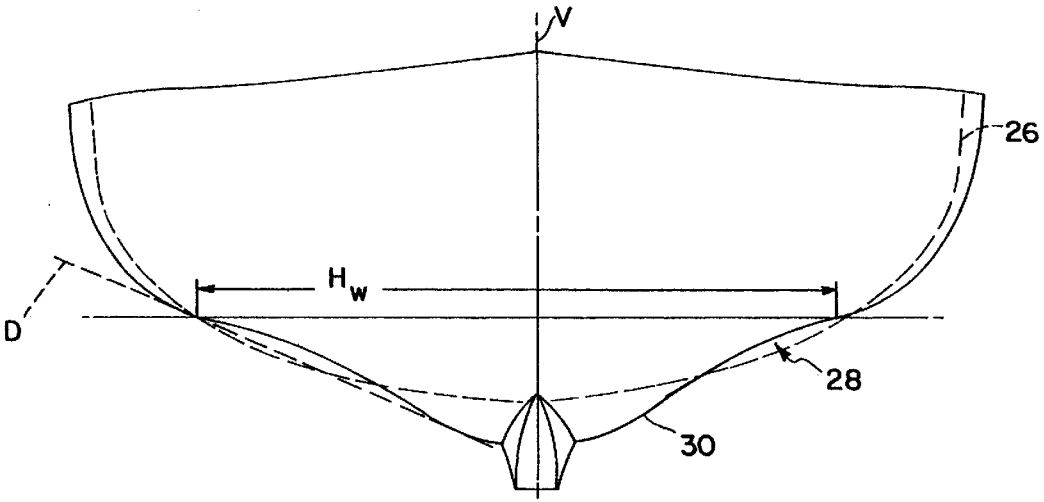
FIG. 13 is a schematic view of a front view of the embodiment of FIG. 1 including a front view of a conventional hull shown in dotted line.
Figure 14:
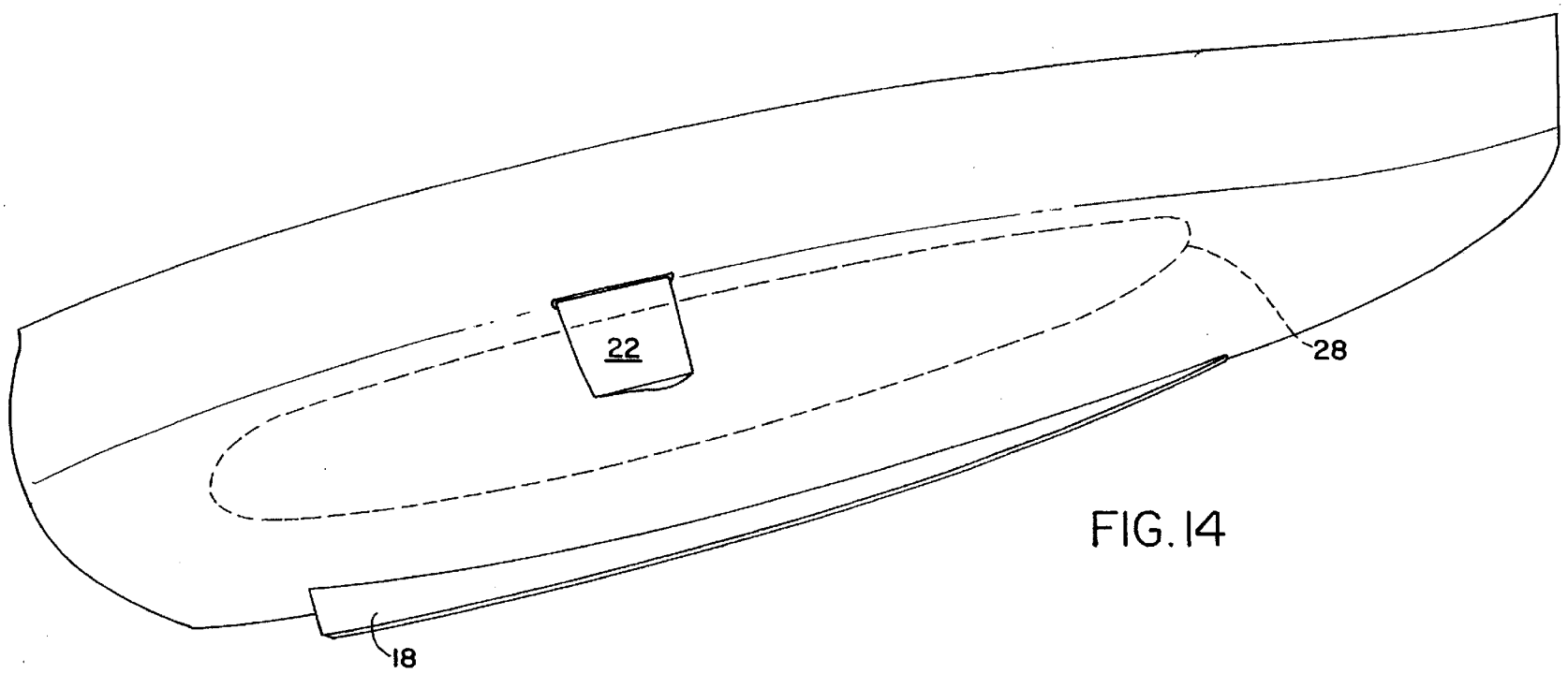
FIG. 14 is a side view showing a hollow area of the hull.
Figure 15:
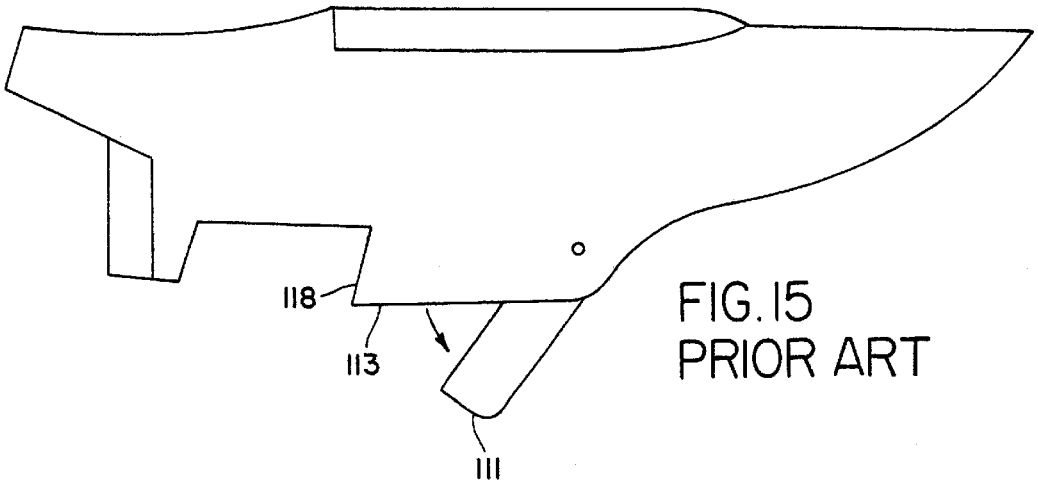
FIG. 15 PRIOR ART
FIG. 15 is a side view of a prior art sailboat.

The placement, length, and depth of the hollow area 28 are determined by the overall length of the boat. The hollow preferably begins at S2 (or 20% aft of the bow) and continues to S8 (or 80% aft of the bow). The length of the waterline of the boat is immaterial to determine the hollow area, as long as it is divided into 10 equal sections or 11 stations. For example, on a 30' boat (measured at waterline), S2 is about 6 feet aft of the bow (or 20% of 30') and S8 is about 24 feet aft of the bow (or 80% of 30'). Therefore, the hollow extends from about 6 feet aft to about 24 feet aft of the bow. In the preferred embodiment, the length of the hollow ($l_h$) extends for about 60% of the length of the boat along the waterline, regardless of the size of the boat. The width of the hollow, "$H_w$", as measured at S5 is about 30" on a 30' boat (FIG. 13). The depth of the hollow as measured from a plane ("D") tangent to a side of the hull, is approximately 2 inches, as measured at S5. As shown in FIG. 14, the hollow preferably has a generally elongated oval or "sausage" shape. When modifying the shape of the hull to include a hollow area, it is preferable to maintain the approximate overall wetted surface area as compared to a conventional sailboat of the same size. In this manner the weight and displacement of the boat is not significantly increased.

The provision of a hull having a hollow area 28 also allows for sufficient headroom below deck in the cabin area. By creating a bulge 30 in the bottom section of the hull which is concave, the cabin floor (or sole) is lowered relative to other conventional shallow water sailboats. The bulge allows the cabin floor to be lowered, and the space inside the hull is also wide enough to create a desirable interior layout with at least 6'4" headroom. Thus, the provision of a hollow area and a bulge allows the boat 10 to have increased stability because the interior weight of the boat is kept low, while also providing sufficient cabin space, particularly headroom.

Figure 3:
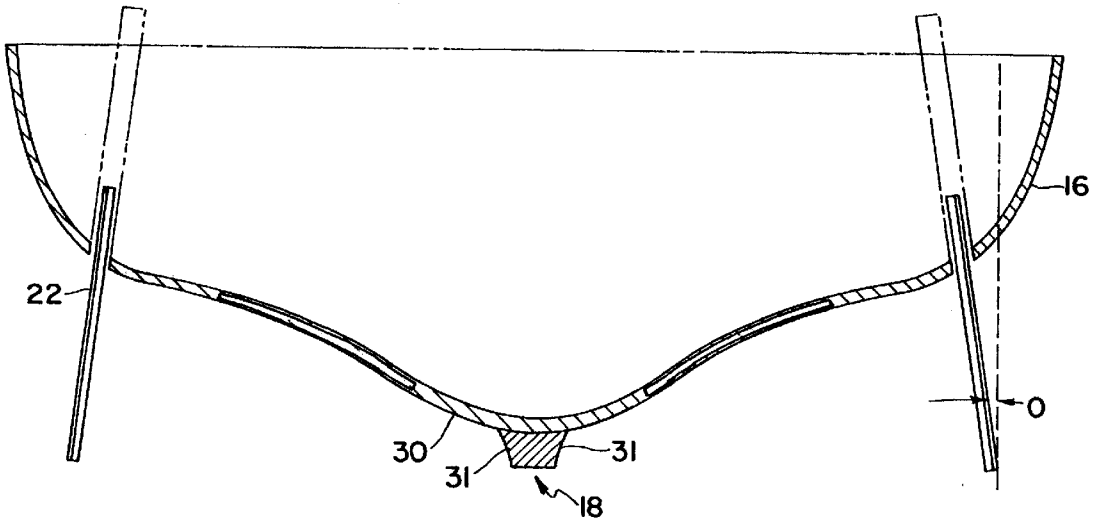
FIG. 3 is a cross-sectional front view of the embodiment of FIG. 1.

Supported on an underside 20 of the hull 16 is keel 18. The keel helps provide additional directional stability and helps prevent leeway or slide-slippage, along with the hull, when sailing. The keel of the present embodiment is designed with a shallow depth so that the boat preferably does not side-slip, have too much drag, can sail in relatively shallow water and be beached. The depth of the keel is preferably related to the length of the hull measured along the waterline, and is preferably about ⅓ of the overall draft of the boat. In the present embodiment, the boat has 1 inch of overall or total draft (hull+keel+lowered appendages) for every 1 foot of waterline. For example, in a boat having a 30 foot waterline, there would preferably be 30 inches in total draft, with the draft of the keel being about 10 inches maximum. The keel also preferably has a length which runs for about 40%–60% of the waterline, and most preferably for about 55%–60% of the length of the waterline (18' on a 30' boat), with the draft being about ⅓ at the midship portion of the keel. The sides 31 of the keel also preferably taper from the underside of the boat inward, as best shown in FIG. 3. The sides preferably have about a 10 degree taper or slope, in the present embodiment, and the keel is substantially flat on the bottom to facilitate beaching the boat. It has been found that the combination of the hull and the keel 18 works well in winds up to about 15 knots and/or about 8 degrees of heel angle of the boat. In order to increase directional stability and prevent side slippage above 15 knots, retractable dagger boards 22 are also provided.

Figure 9:
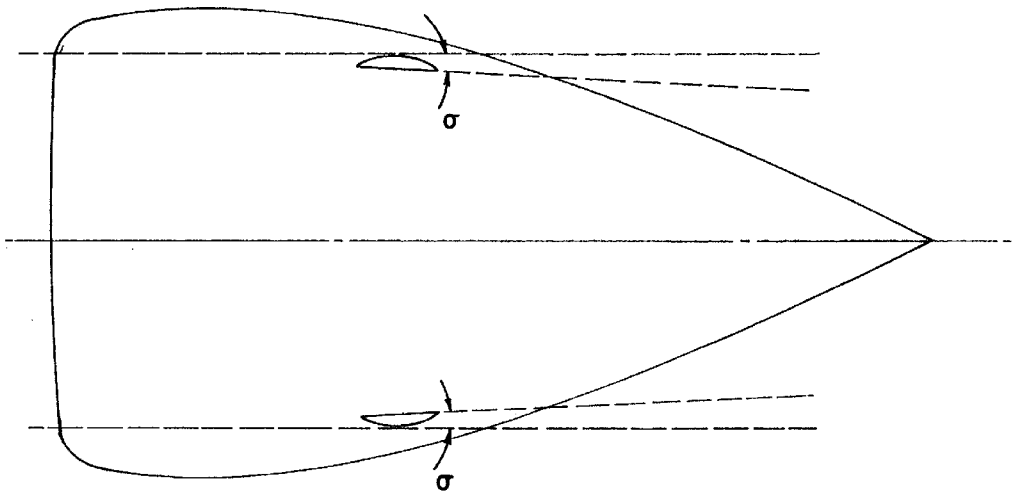
FIG. 9 is a top view of the hull showing the angle of the retractable dagger boards.
Figure 12:
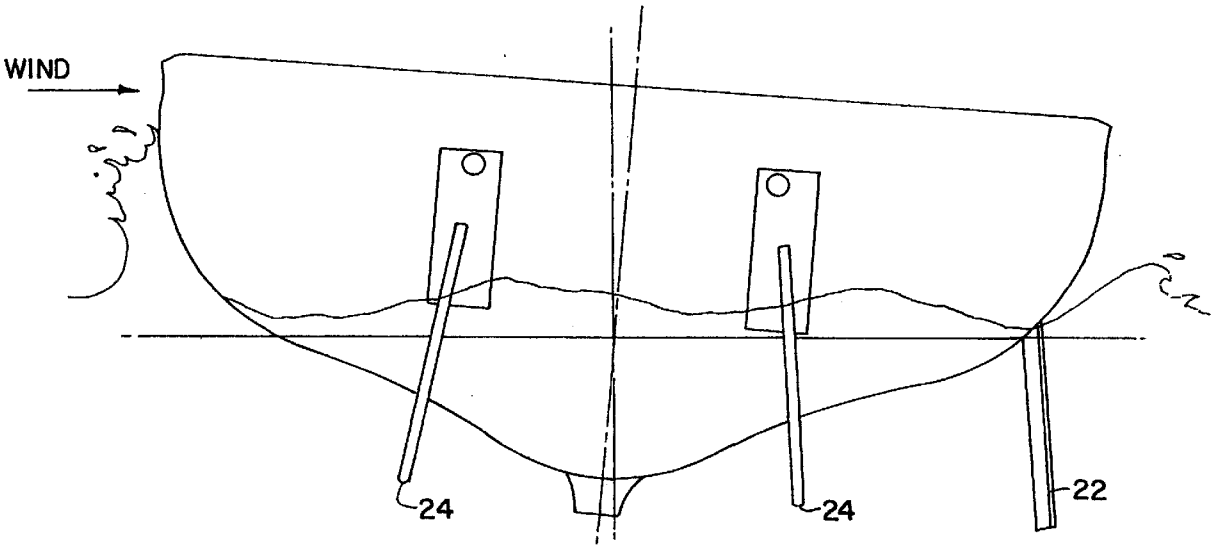
FIG. 12 is a rear view of the hull of the embodiment of FIG. 1 during use.

Dagger boards 22 are preferably located on opposite sides of the keel and are retractable within a slot 32 in the hull when not in use. One dagger board may be extended on the leeward side of the boat when the wind exceeds about 15 knots, so that performance sailing can be maintained (the windward dagger board remains retracted to reduce drag). In the preferred embodiment, the draft of the extended dagger board does not exceed that of the shallow keel so as to not increase the overall draft of the boat. Therefore, on a 30' boat, the overall draft is no more than 30". In addition, to add the necessary lateral plane area and directional stability when the wind increases, the surface area of the dagger boards should be about 3% of the wetted surface area of the boat. For example, on a 30' sailboat the wetted surface area is about 200 sq. feet, and the surface area of each dagger board is about 6 sq. feet. In order for the dagger boards to have a surface area of 6 sq. feet, while having a draft of no more than 30 inches, the width of each must be about 29 inches. The dagger boards are disposed at an angle ($\theta$) of about 8 degrees outboard (FIG. 3), so that the boards remain perpendicular when the boat is heeled at 8 degrees (FIG. 12). The dagger boards are also placed at an angle ($\sigma$) inwards toward the center plane by about 3 degrees to help improve directional stability (FIG. 9). The dagger boards are also preferably placed outboard on the hull, and at an angle ($\epsilon$) of about 24 degrees forward, so that when extended, the dagger boards drop down directly above the waterline, so as to reduce turbulence at the slot in the hull when the boat is sailing upright in light winds.

Figure 11:
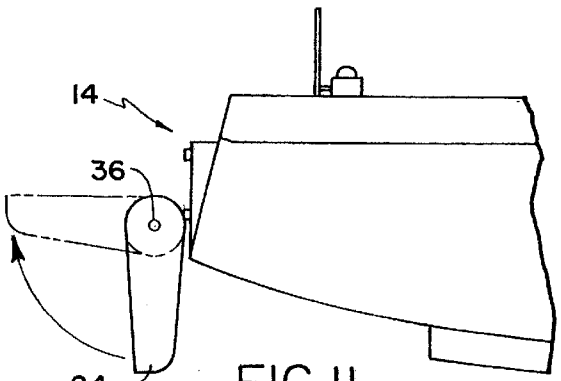
FIG. 11 is a partial side view of the aft of the hull of FIG. 1 showing the rudder.
Figure 10:
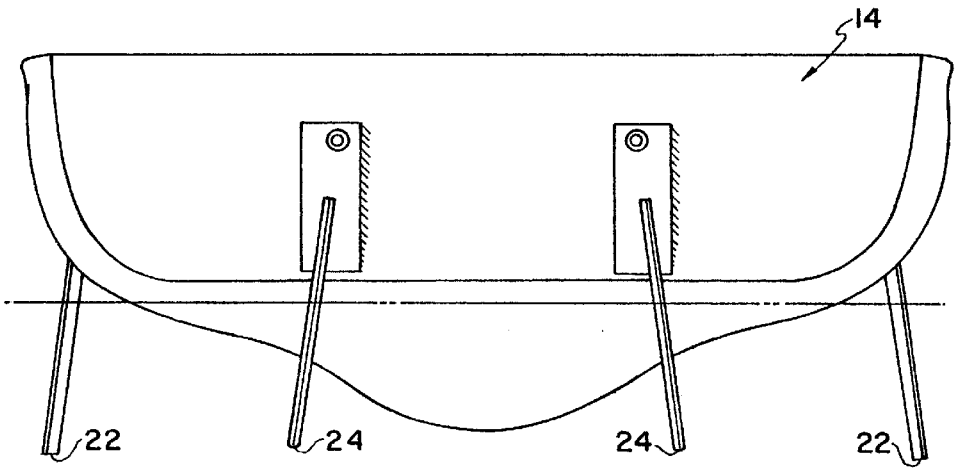
FIG. 10 is a rear view of the hull of the embodiment of FIG. 1.

Another component of the present boat 10 which helps prevent leeway is the provision of dual rudders 24. The rudders are preferably set at an angle directly behind the dimensional hollow area 28, on the stern of the boat. This allows smaller rudders, i.e. with a smaller surface area, to be utilized to steer the boat as compared to rudders on other conventional shallow water sailboats. The rudder size is about 3% of the wetted surface area of the boat, or about 6 sq. feet for a hull with 200 sq. feet of wetted surface area. Like the dagger boards, the rudders preferably do not extend below the keel, i.e. they do not increase the overall draft of the boat. The rudders may also be raised by pivoting the rudders 90 degrees about axis 36 as shown in FIG. 11.

In operation, the shallow water or shoal sailing boat 10 is capable of performance-type sailing at all points of wind, even in shallow water of about 3 feet or less. The shoal water boat, unlike prior art designs, has sufficient lift, without the negative influence of increased drag. It is believed that this is due to the manner in which the water under the hull is agitated in order to sustain the lift. When the wind increases to about 15 knots, or when the boat heels at about an 8 degree angle, a dagger board is lowered to the leeward side of the boat in order to help stop side slippage at the increased wind speeds. When lowered, the dagger board does not extend below the draft of the shallow keel. In winds lower than about 15 knots, the dagger boards are stored in a slot within the hull. The dagger boards are raised and lowered in a conventional manner by the crew of the boat, as desired. The hull design, shallow keel, retractable dagger boards, and pivotal rudders allows the boat 10 to be sailed at all points of sail in shallow water, and right up onto a beach without any damage to the boat.

It will be understood that various modifications may be made to the embodiment disclosed herein. For example, although the boat described has an overall length of 32 feet and a length of 30 feet at the waterline, it should be understood that the boat may have any desired length. When changing the length, the other dimensions described herein will be changed accordingly, as would be known to one of skill in the art. In addition, the dimensions described herein are approximate, and may fall within a range, provided that shallow water, performance sailing is substantially maintained. Therefore, the above description should not be construed as limiting, but merely as exemplifications of a preferred embodiment. Those skilled in the art will envision other modifications within the scope, spirit and intent of the invention.

What is claimed is:

1. A sailboat capable of sailing to windward in shallow water and including a bow and a stern, the sailboat comprising:

a hull including a waterline, and having a modified U-shape forming a hollow area and bulge in a bottom section of the hull;

a shallow keel supported on an underside of the hull;

a pair of retractable dagger boards supported by the hull and disposed on either side of keel;

wherein the sailboat has an overall draft of about one inch for every foot of waterline, the keel has a draft of about ⅓ of the overall draft at its deepest point, and the dagger boards extend no further than the draft of the keel, so as to not increase the overall draft of the sailboat.

2. The sailboat of claim 1, wherein a maximum width of the hull at the waterline is preferably about 33% of the length of the sailboat at the waterline.

3. The sailboat of claim 2, wherein the maximum width is preferably located about 70% aft of the bow of the sailboat.

4. The sailboat of claim 1, wherein the hollow area preferably begins about 20% aft of the bow and continues until about 80% aft of the bow.

5. The sailboat of claim 1, wherein the keel extends along the hull for about 60% of the length of the waterline.

6. The sailboat of claim 1, wherein the keel includes a pair of sides which are tapered from the underside of the boat inward, and a substantially flat bottom surface.

7. The sailboat of claim 6, wherein the sides of the keel taper about 10 degrees inward, toward a vertical plane disposed through the center of the sailboat, along the length of the sailboat.

8. The sailboat of claim 1, wherein the hull includes a slot to store the dagger boards in the retracted position.

9. The sailboat of claim 1, wherein one dagger board is extended on a leeward side of the boat when the wind exceeds a predetermined velocity.

10. The sailboat of claim 9, wherein the predetermined velocity is about 15 knots.

11. The sailboat of claim 9, wherein the surface area of the dagger boards is about 3% of a wetted surface area of the sailboat.

12. The sailboat of claim 9, wherein each dagger board is disposed at an angle of about 8 degrees outboard, so that the dagger boards remain perpendicular when the sailboat is heeled at about 8 degrees.

13. The sailboat of claim 1, wherein one dagger board is extended on a leeward side of the boat when the sailboat heels at about an 8 degree angle.

14. The sailboat of claim 1, further comprising a pair of rudders supported on the sailboat behind the hollow area, on the stem of the sailboat.

15. The sailboat of claim 14, wherein the rudders extend no further than the draft of the keel, so as to not increase the overall draft of the sailboat.

16. The sailboat of claim 14, wherein the rudders are pivotable about an axis so as to be raised.

17. The sailboat of claim 1, wherein the hull of the present invention preferably includes eleven stations.

18. A sailboat capable of sailing to windward in shallow water and including a bow and a stem, the sailboat comprising:

a hull having a modified U-shape and including a waterline;

a shallow keel supported on an underside of the hull;

a pair of retractable dagger boards supported by the hull and disposed on either side of keel;

wherein an overall draft of the sailboat including the depth of the hull measured from the waterline to the underside of the hull, the depth of the keel, and the length of the dagger boards in an extended position, is about one inch for every foot of length of waterline of the sailboat.

19. The sailboat of claim 18, wherein the hull includes a hollow area and a bulge in a bottom section of the hull, the hollow area extending from about 20% aft of the bow and continuing until about 80% aft of the bow.

20. The sailboat of claim 18, wherein the maximum width of the hull at the waterline is preferably about 33% of the length of the boat at the waterline and is located about 70% aft of the bow of the boat.

21. The sailboat of claim 18, wherein the keel extends along the hull for about 60% of the length of the waterline and includes a pair of sides which are tapered from the underside of the boat inward, and a substantially flat bottom surface.

22. The sailboat of claim 18, wherein one dagger board is extended on a leeward side of the boat when the wind exceeds a predetermined velocity.

23. The sailboat of claim 18, wherein one dagger board is extended on a leeward side of the boat when the boat heels at about an 8 degree angle.

24. The sailboat of claim 18, further comprising a pair of rudders supported on the stem of the sailboat, and wherein the rudders extend no further than the overall draft of the sailboat.

* * * * *

UNITED STATES PATENT AND TRADEMARK OFFICE

CERTIFICATE OF CORRECTION

PATENT NO. : 6,325,009 B1 
DATED : December 4, 2001
INVENTOR(S) : Walter A. Schulz et al.

It is certified that error appears in the above-identified patent and that said Letters Patent is hereby corrected as shown below:

Drawings,
Figure 4, replace each occurrence of the following: “56” with -- S6 --, “55” with -- S5--, “54” with -- S4”, “53” with -- S3 --, “52” with -- S2 --, “51” with -- S1 -- and “50” with -- S0 --.
Figure 5, replace the following: “59” with -- S9 --, “58” with -- S8 --, “57” with -- S7 --, “56” with -- S6 --, “55” with -- S5 --, “54” with -- S4 --, “53” with -- S3 --, “52” with -- S2 --, “51” with -- S1 -- and “50” with -- S0 --.

Signed and Sealed this

Twenty-third Day of March, 2004

JON W. DUDAS
*Acting Director of the United States Patent and Trademark Office*